US005996564A

United States Patent [19]

Kotowski

[11] Patent Number: 5,996,564

[45] Date of Patent: Dec. 7, 1999

[54] DISC DISCHARGING DEVICE

[75] Inventor: Paul J. Kotowski, Foster, R.I.

[73] Assignee: Kids Only, Framington, Mass.

[21] Appl. No.: 09/133,513

[22] Filed: Aug. 12, 1998

[51] Int. Cl.[6] ..... F41B 4/00

[52] U.S. Cl. ..... 124/6; 124/82

[58] Field of Search ..... 124/4, 6, 16, 32, 124/42, 43, 46, 47, 51.1, 78, 82

[56] References Cited

U.S. PATENT DOCUMENTS

| | | | |
|---|---|---|---|
| 3,717,136 | 2/1973 | Gay et al. | 124/21 |
| 5,050,575 | 9/1991 | Killion | 124/8 |
| 5,471,967 | 12/1995 | Matsuzaki et al. | 124/6 |
| 5,611,322 | 3/1997 | Matsuzaki et al. | 124/6 |
| 5,782,228 | 7/1998 | Wu | 124/6 |

FOREIGN PATENT DOCUMENTS

| | | | |
|---|---|---|---|
| 1221593 | 5/1987 | Canada | 124/78 |

*Primary Examiner*—John A. Ricci
*Attorney, Agent, or Firm*—Iandiorio & Teska

[57] ABSTRACT

A disc discharging toy includes a body having a hand grip; a plurality of resilient discs; a magazine mounted on the body and containing the plurality of resilient discs in a stacked position; and a single drive roller driven by a motor and imparting a discharge force to each disc when fed into a discharge position wherein the drive roller has an axis of rotation perpendicular to the axis of each resilient disc.

2 Claims, 5 Drawing Sheets

DISC DISCHARGING DEVICE

FIELD OF INVENTION

This invention relates to a toy for discharging foam discs.

BACKGROUND OF INVENTION

A known motorized disc discharging toy is shown in U.S. Pat. No. 5,471,967. In this design, a motor-driven roller is rotatably attached to one side of a partition plate such that the drive roller axis of rotation is parallel to the axis of the discs. Further required is a second idler roller on the other side of the partition plate defining a gap with the drive roller through which each disc is discharged.

The requirement that the drive roller be physically mounted to the partition plate renders this design bulky because the plate must have at least one protruding section to accommodate the drive roller and the motor. Furthermore, the second idler roller required in this design adds to the toy's expense. Indeed, in one embodiment, two drive rollers are required, one on each side of the partition plate.

SUMMARY OF INVENTION

It is therefore an object of this invention to provide a more streamlined disc discharging toy.

It is a further object of this invention to provide such a disc discharging toy which does not require an idler roller or a second drive roller.

It is a further object of this invention to provide such a disc discharging toy which is simpler in design, and easier and less expensive to manufacture.

This invention results from the realization that the need for a second drive roller or an idler roller in a disc discharging toy and the requirement of a partition plate large enough to accommodate both the idler roller and the drive roller(s) can be eliminated if the drive roller is disposed perpendicular to the partition plate. In other words, instead of placing the drive roller flat on the partition plate such that the drive roller's axis of rotation is parallel to the disc axis, the drive roller is rotatably attached to the upper portion of the toy housing and has an axis of rotation perpendicular to the disc axis.

This invention features a disc discharging toy comprising a body having a hand grip; a plurality of resilient discs; a magazine mounted on the body and containing the plurality of resilient discs in a stacked position; means for discharging the discs one by one from the body; means for feeding the discs one by one from the magazine to the discharging means; wherein each disc includes upper and lower planar surfaces and a disc axis orthogonal to said upper and lower planar surfaces. The disc discharging means includes a single drive roller driven by a motor and imparting a discharge force to each disc when fed into a discharge position by the means for feeding and wherein the drive roller has an axis of rotation perpendicular to the axis of each resilient disc.

Such a configuration results in a more streamlined toy and eliminates the need for a second drive roller and/or an idler roller. Each disc is typically toroidally shaped and made of a material selected from the group consisting of rubber, vinyl chloride, urethane foam, and polyethylene foam. The body portion includes a grip portion, a lower housing portion, a partition plate, and an upper housing portion. The partition plate separates the lower housing portion from the upper housing portion. The grip portion is attached to the lower housing portion. The magazine resides on the upper housing portion. The single drive roller is rotatably attached to the upper housing portion which also includes the motor. A battery is disposed in the grip portion and connected via a switch to the motor.

The discharging means further includes a stationary resilient bumper defining a gap with the drive roller through which each disc is discharged. The means for feeding the discs typically includes a trigger which engages a sliding plate. The trigger includes teeth which cooperate with a ratchet portion of the sliding plate.

The disc discharging toy of this invention includes a plurality of resilient discs; a supply portion for holding the plurality of discs in a stacked position; feeding means for forcibly feeding the discs held in the supply portion one by one to a discharging position; a single roller having a side which engages a disc in the discharging position; and a motor for rotating the single roller to discharge the disc. The plurality of discs are typically substantially toroidally shaped. The disc discharging toy further comprises a grip, the feeding means including a trigger mounted adjacent the grip, and a sliding plate operatively coupled to the trigger to forcibly feed each disc to the discharging position.

A disc discharging toy in accordance with this invention features a plate having two opposite sides, a forward portion, and a rearward portion; means for holding a plurality of discs in a vertical stack over the plate; a roller driven by an electric motor, the roller rotatably attached to a housing disposed over the plate; and means for feeding a lower-most one of the discs into engagement with a side of the single roller to thereby be discharged from the forward position of the plate. Further included is a stationary bumper positioned on one side of the plate. The improvement in motor-driven disc discharging toys of this invention is a roller having an axis of rotation perpendicular to the axis of the disc to thereby eliminate the need for an additional roller and to provide a more streamlined toy configuration.

BRIEF DESCRIPTION OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
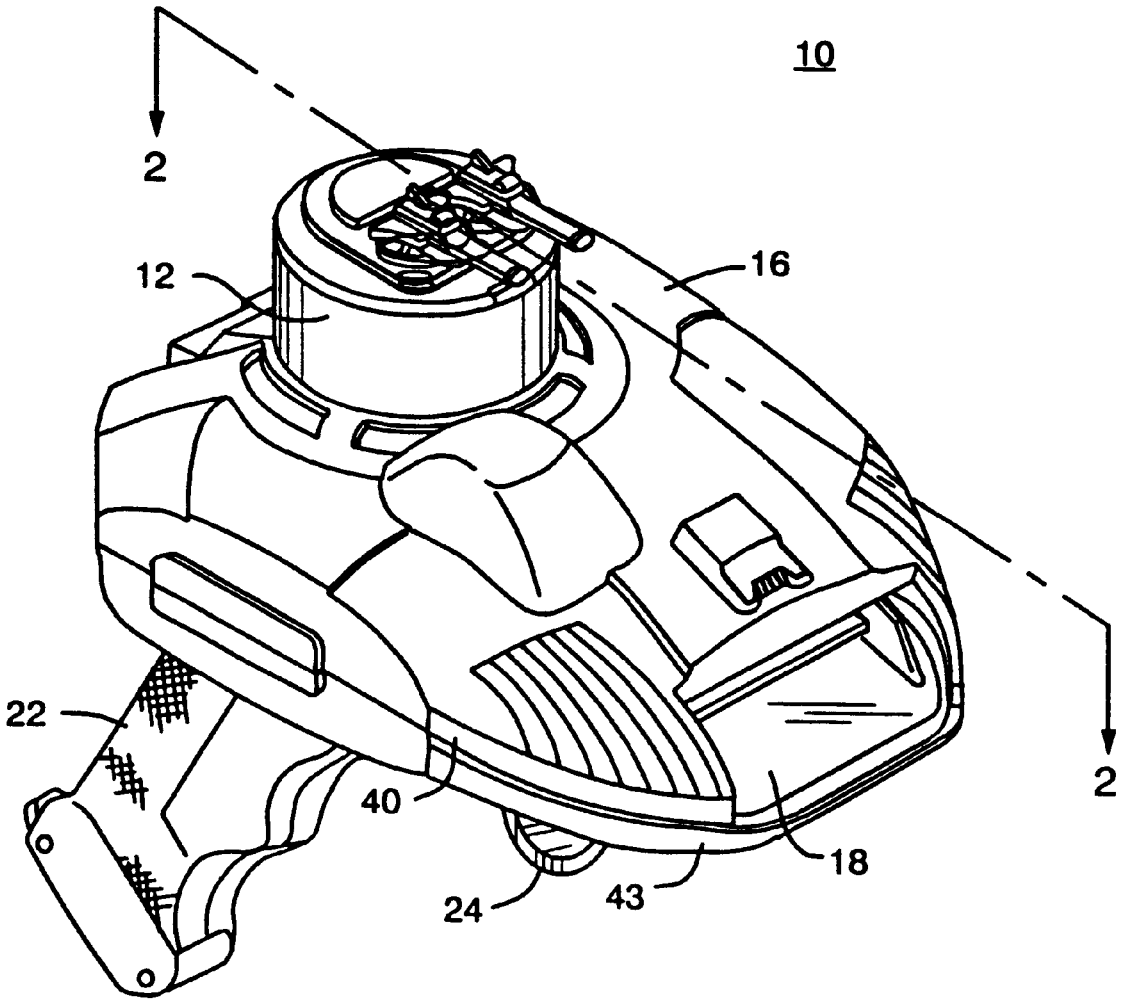
FIG. 1 is a schematic view of the disc discharging toy of the subject invention.
Figure 2:
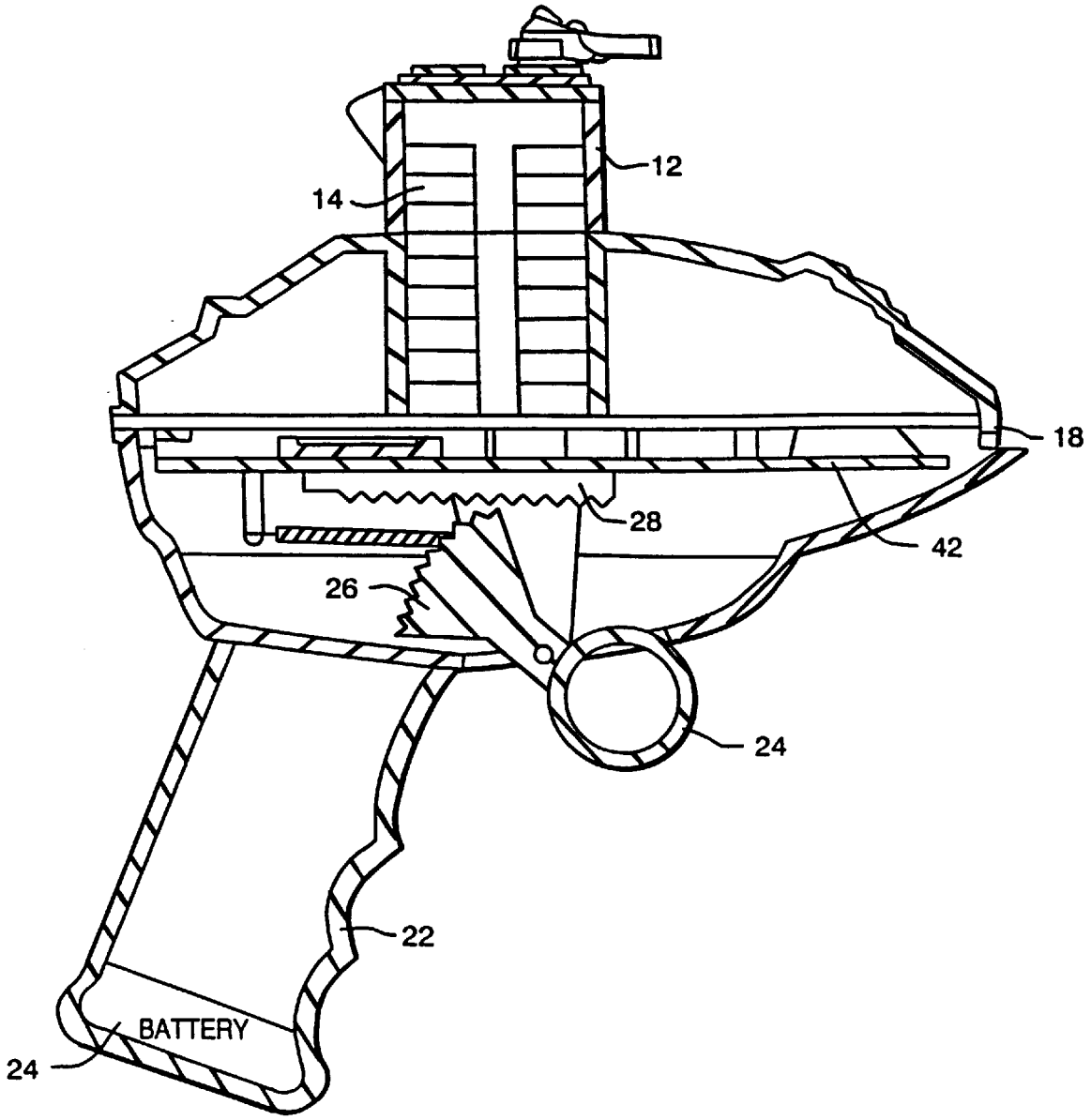
FIG. 2 is a sectional view taken along line 2—2 of FIG. 1.

Disc discharging toy 10, FIG. 1, fires a plurality of resilient discs 14, FIG. 2, stacked in magazine portion 12 mounted on toy body 16. There are means for discharging the discs one by one from body 16 via orifice 18 including the combination of vertically disposed single drive roller 20, FIG. 4, driven by a switch activated motor M in motor mount 21 powered by battery 24 in handle 22. There are also means for feeding the discs one by one to roller 20 including the combination of trigger 24 which extends through orifice 51 in lower body portion 43 and has teeth 26 which engage, through orifice 29 in plate 42, ratchet portion 28 of sliding disc feeding plate 30, FIG. 3.

Figure 4:
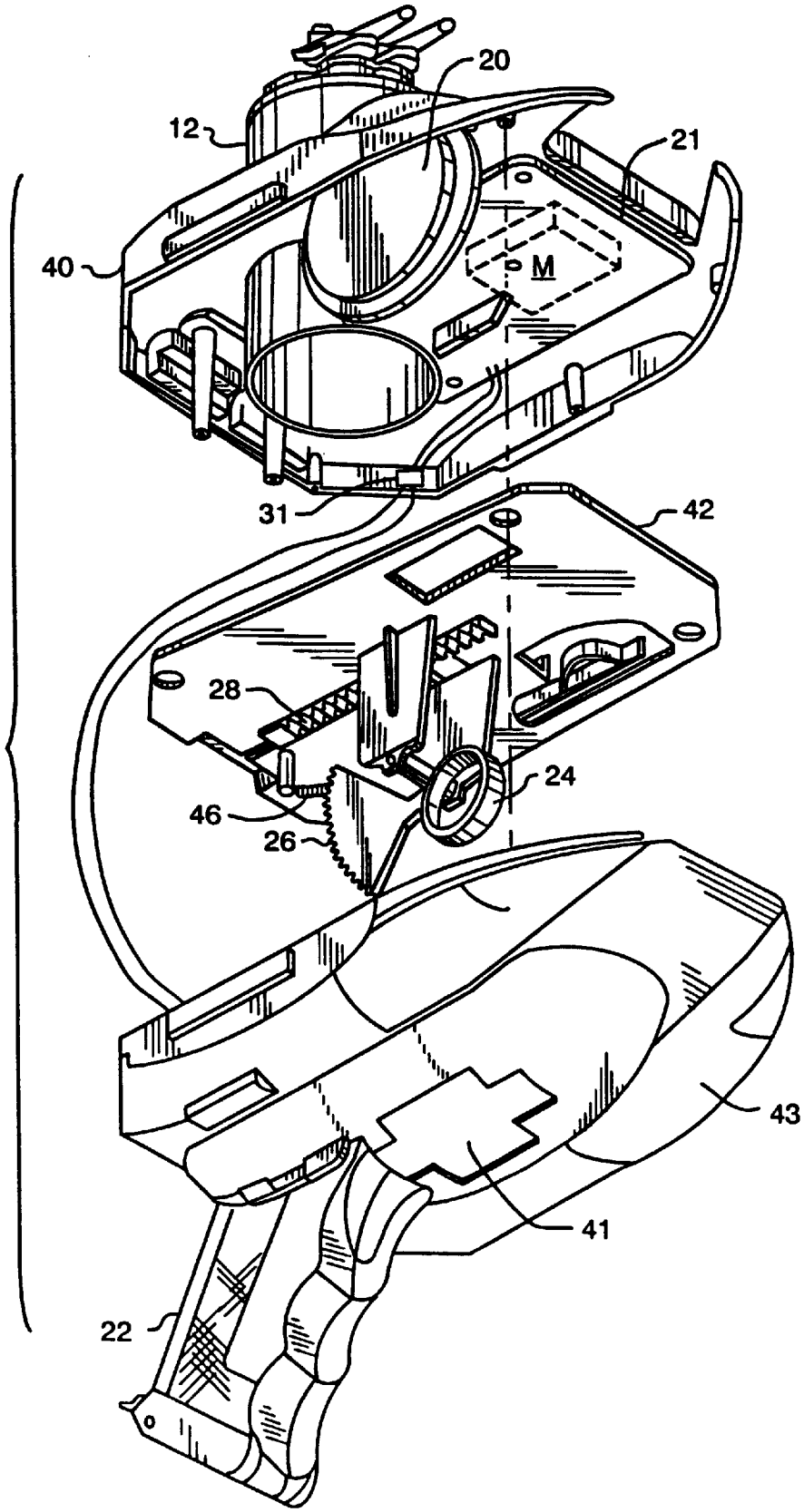
FIG. 4 is a bottom exploded view of the disc discharging toy of the subject invention.
Figure 6:
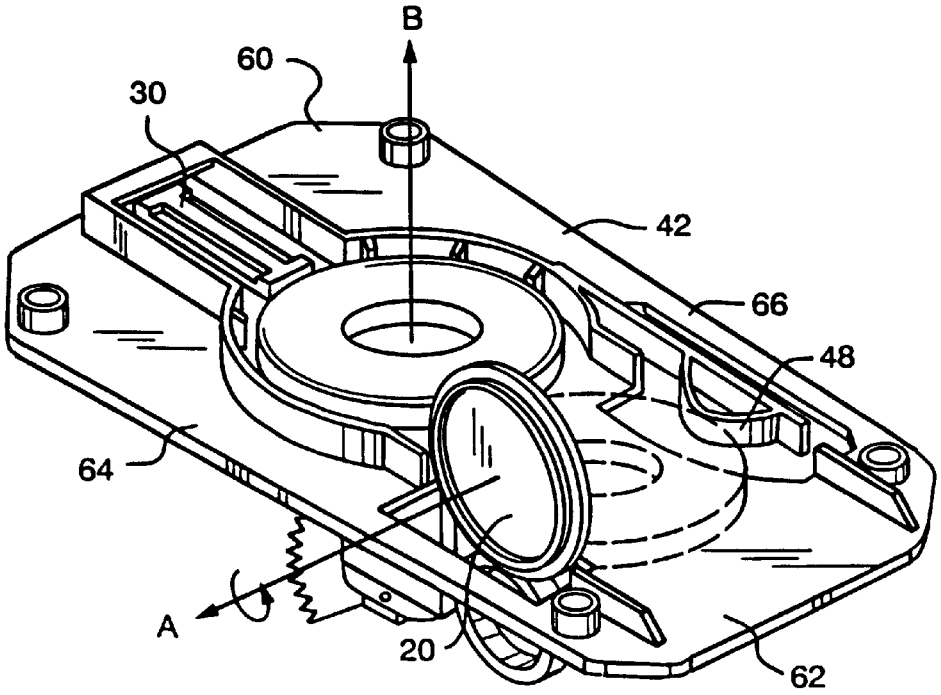
FIG. 6 is a top schematic view showing the arrangement of the drive roller with respect to the discs in the subject invention.

Drive roller 20, FIGS. 4 and 6, has an axis of rotation A perpendicular to axis B of each resilient disc orthogonal to the upper and lower planar surfaces of each disc as shown.

Figure 5:
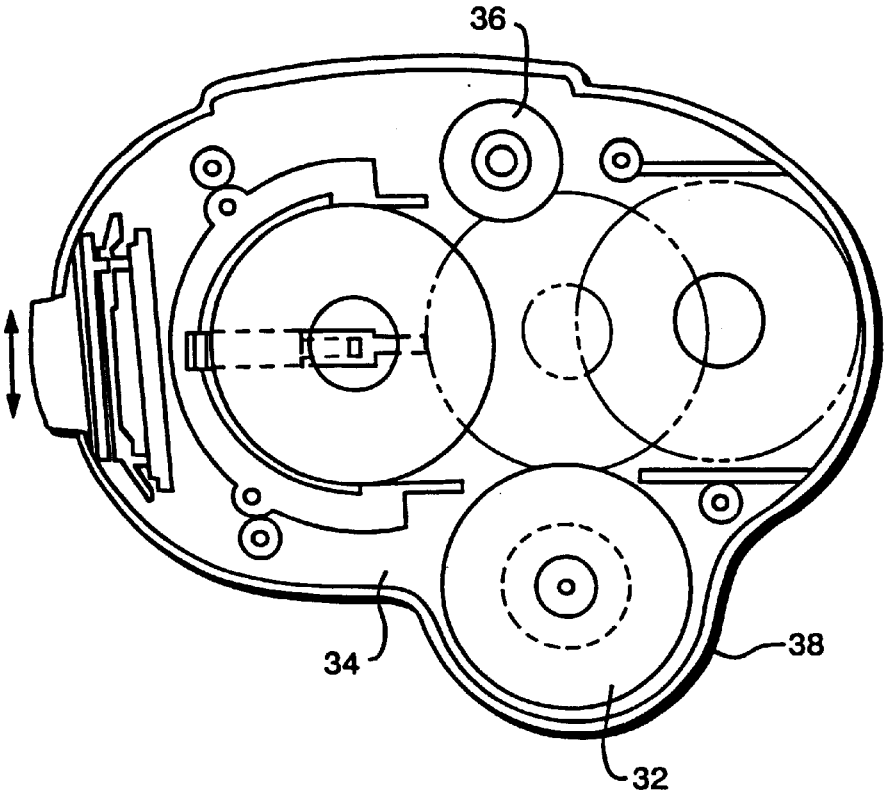
FIG. 5 (PRIOR ART)
FIG. 5 is a top view showing the arrangement of the drive roller with respect to the disc in a prior art disc discharging toy.

In contrast, in the prior art (see U.S. Pat. No. 5,471,967), drive roller 32, FIG. 5, has an axis of rotation parallel to the axis of each resilient disc. As such, roller 32 of the prior art design must be mounted on one side of plate 34 and second idler roller 36 is required. In addition, the edge of prior art roller 32 engages the discs. In the subject invention, however, the bulkiness of this prior art design and the cost associated with second idler roller 36 are eliminated. Protruding section 38, FIG. 5, of plate 34 is eliminated in the subject invention as shown in FIG. 6 because roller 20 is mounted to upper portion 40 of housing 16 disposed over plate 42. And, instead of the edge of roller 20 engaging the discs, interior side surface 59, FIG. 4, of roller 20 engages the discs.

In operation, when switch 31 is activated, the motor in housing 21 spins drive roller 20. When trigger 24 is pulled toward handle 22, teeth 26 drives plate 30 forward pushing the lowermost disc in the stack such that the periphery thereof engages inside surface 59 of spinning drive roller 20 imparting a disc discharging force to the disc which sends it spinning out of orifice 18. Spring 46 returns trigger 24 and plate 30 back to the firing position to discharge the next disc in the stack. Stationary (non-rotating) resilient bumper 48, FIGS. 3 and 6, on plate 42, defines a gap between the side of drive roller 20 and bumper 48 such that bumper 48 guides the discs into a position where the edges contact drive roller 20 and then out of orifice 18 eliminating the need for a costly idler roller or an additional drive roller. In addition, in this invention drive roller 20 is the only roller and there is no need for a second drive roller. Bumper 48 holds one side of the disc stationary while drive roller 20 imparts a rotation force to the other side of the disc.

As with prior art designs, each disc is preferably made toroidal in shape from rubber, vinyl fluoride, urethane foam, or polyethylene foam.

Figure 3:
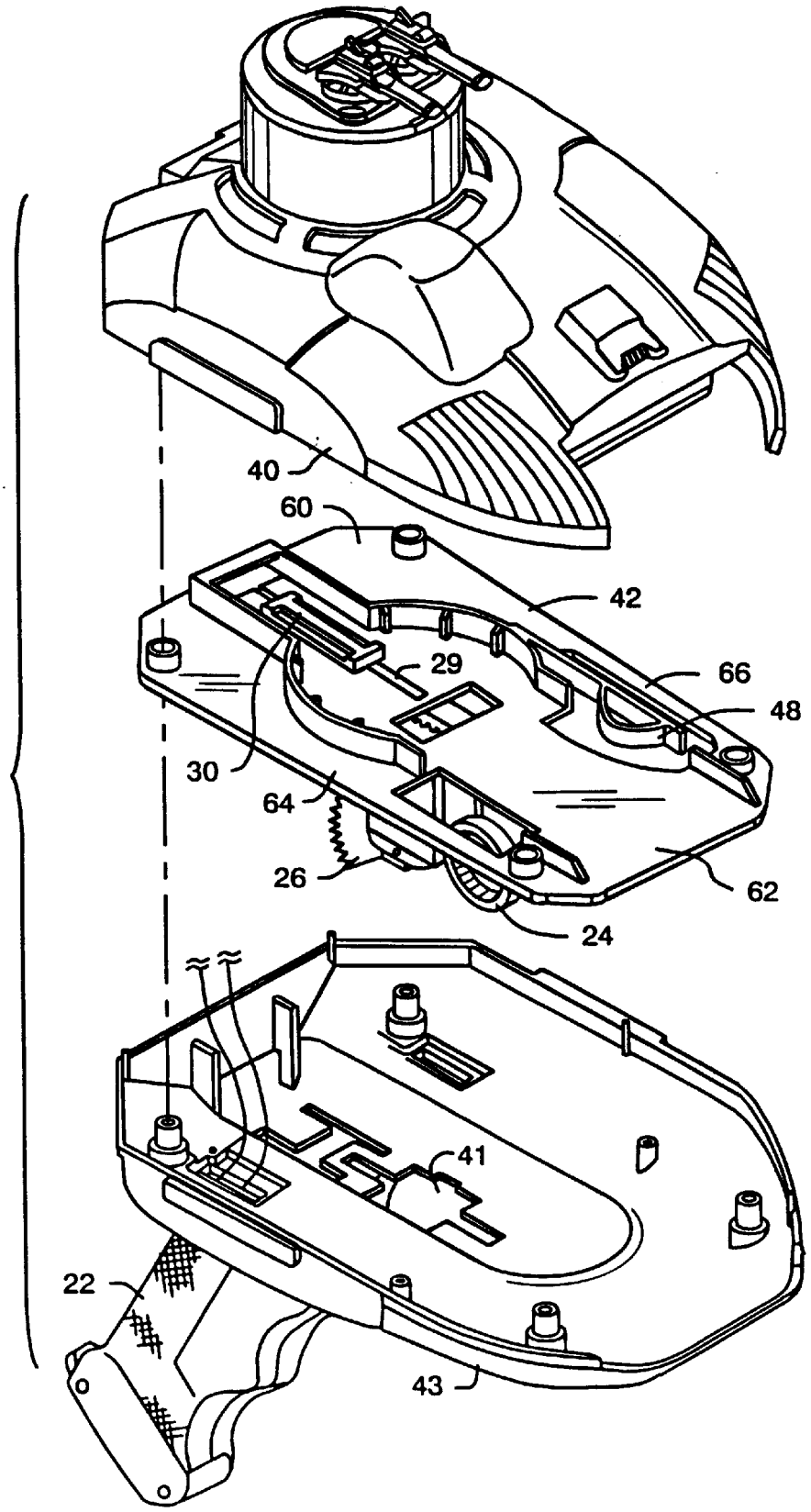
FIG. 3 is a top exploded view of the disc discharging toy of the subject invention.

Plate 42, FIGS. 3 and 6, has rearward portion 60 including slidable plate 30, forward portion 62 for discharging the disc, and opposite sides 64 and 66, but instead of positioning drive roller 20 on one side of plate 42, drive roller 20 is positioned above plate 42 on upper portion 40 of housing 16. The result is a much more streamlined toy.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A disc discharging toy comprising:

a body having a hand grip;

a plurality of resilient discs;

a magazine mounted on the body and containing the plurality of resilient discs in a stacked position;

means for discharging the discs one by one from the body;

means for feeding the discs one by one from the magazine to the discharging means, the disc feeding means including a trigger which engages a sliding plate, the trigger having teeth which cooperate with a ratchet portion of the sliding plate;

wherein each disc includes upper and lower planar surfaces and a disc axis orthogonal to said upper and lower planar surfaces, wherein the disc discharging means includes a single drive roller driven by a motor and imparting a discharge force to each disc when fed into a discharge position by the means for feeding and wherein the drive roller has an axis of rotation perpendicular to the axis of each resilient disc.

2. A disc discharging toy comprising:

a plate having two opposite sides, a forward portion, and a rearward portion;

means for holding plurality of discs in a vertical stack over the plate;

a roller driven by an electric motor, the roller rotatably attached to a housing disposed over the plate; and means for feeding a lower-most one of the discs into engagement with a side of the single roller to thereby be discharged from the forward position of the plate, the feeding means including a trigger which engages a sliding plate, the trigger having teeth which cooperate with a ratchet portion of the sliding plate.

* * * * *